US005756446A

United States Patent [19]

Bator et al.

[11] Patent Number: 5,756,446

[45] Date of Patent: May 26, 1998

[54] SUGAR SURFACTANTS HAVING ENHANCED TACTILE PROPERTIES

[75] Inventors: Patricia E. Bator, Secaucus; Arturo Valdes, Weehawken, both of N.J.

[73] Assignee: Henkel Corporation, Plymouth Meeting, Pa.

[21] Appl. No.: 646,176

[22] Filed: May 7, 1996

[51] Int. Cl.[6] ..... C11D 3/22; C11D 3/37; C11D 11/00; C11D 17/00

[52] U.S. Cl. ..... 510/535; 510/123; 510/433; 510/470; 510/475; 510/501; 510/502; 510/504

[58] Field of Search ..... 510/470, 535, 510/471, 472, 536, 537, 475, 504, 501, 502, 121, 123, 124, 126, 433; 252/168, 200, 167, 199, 244, 245, 239

[56] References Cited

U.S. PATENT DOCUMENTS

| | | | |
|---|---|---|---|
| 5,057,311 | 10/1991 | Kamegai et al. | 424/70.13 |
| 5,109,127 | 4/1992 | Sekiguchi et al. | 536/115 |
| 5,174,927 | 12/1992 | Honsa | 252/543 |
| 5,190,747 | 3/1993 | Sekiguchi et al. | 424/56 |
| 5,223,179 | 6/1993 | Connor et al. | 252/548 |
| 5,234,618 | 8/1993 | Kamegai et al. | 510/382 |
| 5,266,690 | 11/1993 | McCurry, Jr. et al. | 536/18.6 |
| 5,310,542 | 5/1994 | Au et al. | 424/52 |
| 5,332,528 | 7/1994 | Pan et al. | 252/548 |
| 5,338,491 | 8/1994 | Connor et al. | 252/548 |
| 5,352,386 | 10/1994 | Rahman et al. | 252/548 |
| 5,352,387 | 10/1994 | Rahman et al. | 252/548 |
| 5,358,656 | 10/1994 | Humphreys et al. | 252/174 |
| 5,567,808 | 10/1996 | Desai et al. | 536/4.1 |

FOREIGN PATENT DOCUMENTS

| | | |
|---|---|---|
| 0550279 | 12/1992 | European Pat. Off. . |
| 0550280 | 12/1992 | European Pat. Off. . |
| 0550281 | 12/1992 | European Pat. Off. . |

*Primary Examiner*—Ardith Hertzog

*Attorney, Agent, or Firm*—Ernest G. Szoke; Wayne C. Jaeschke; Steven J. Trzaska

[57] ABSTRACT

A surfactant composition containing: (a) a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof; and (b) an additive consisting of a copolymer of acrylamide and dimethyl diallyl ammonium chloride.

24 Claims, No Drawings

SUGAR SURFACTANTS HAVING ENHANCED TACTILE PROPERTIES

FIELD OF THE INVENTION

The present invention relates to a composition and process for enhancing the tactile and aesthetic properties of sugar surfactants. More particularly, by adding an effective amount of a polyquaternium component to a sugar surfactant, the tactile properties of the sugar surfactant are significantly enhanced.

BACKGROUND OF THE INVENTION

Sugar surfactants such as, for example, alkyl polyglycosides or fatty acid-N-alkyl glucamides, are distinguished from other surfactants by their excellent detergent properties and high ecotoxicological compatibility. For this reason, these classes of nonionic surfactants are acquiring increasing significance. They are generally used in liquid formulations, for example dishwashing detergents and hair shampoos.

While conventional sugar surfactants perform satisfactorily in many applications, there is a constant need to both enhance and expand their performance properties. Methods of improving the performance of conventional sugar surfactants by increasing their: foaming and foam stability, tolerance to water hardness and detergency, continue to be sought.

A specific problem associated with sugar surfactants, however, relates to the undesirable tactile properties which they impart onto both skin and hair upon contact with the human body, commonly referred to in the industry by the term "scroopiness". More particularly, sugar surfactants such as alkyl polyglycosides, when applied onto hair and/or skin tend to make it feel rough, dry and sticky as if hairspray were applied thereon. However, due to their nonionic character, synergistic relationship with other surfactants, tendency towards high foaming and mildness with respect to skin irritation, sugar surfactants have become highly desirable surfactants for use in the personal care products industry.

Thus, it is a primary object of this invention to provide a means for enhancing the tactile properties of sugar surfactants, thereby making their use more acceptable in the personal care products industry.

SUMMARY OF THE INVENTION

The present invention is thus directed to a surfactant composition containing:

(a) a sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof; and (b) an additive consisting of a copolymer of acrylamide and dimethyl diallyl ammonium chloride.

The present invention also provides a process for improving the tactile properties of a sugar surfactant involving adding an effective amount of the above-disclosed additive to a nonionic sugar surfactant selected from the group consisting of alkyl glucose esters, aldobionamides, gluconamides, glyceramides, glyceroglycolipids, polyhydroxy fatty acid amides, alkyl polyglycosides of formula I and mixtures thereof.

The present invention also provides a cleansing composition for treating keratinous substrates, the composition containing:

(a) from about 2 to about 15% by weight of the above-disclosed surfactant composition; and (b) remainder water.

DESCRIPTION OF THE INVENTION

Other than in the operating examples, or where otherwise indicated, all number expressing quantities of ingredients or reaction conditions used herein are to be understood as being modified in all instances by the term "about".

The term nonionic sugar surfactant as used herein refers to surfactants that are based on saccharide moieties. The nonionic sugar surfactants which may be employed in the present invention are selected from the group consisting of alkyl polyglycosides, alkyl glucose esters, aldobionamides, gluconamides, glyceramides, glyceroglycolipids, polyhydroxy fatty acid amides, and mixtures thereof.

Preferred alkyl polyglycosides which can be used as the complexing agent in the concentrate of the invention have the formula 1:

$$R_1O(R_2O)_b(Z)_a \qquad \text{I}$$

wherein Z is a glucose residue and b is zero. Such alkyl polyglycosides are commercially available, for example, as GLUCOPON®, or PLANTAREN® surfactants from Henkel Corporation, Ambler, PA., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.6.
3. GLUCOPON® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.6.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated. The alkyl polyglycoside of the present invention acts as the complexing agent for the iodine complex concentrate.

The alkyl glucose ester sugar surfactants are generally disclosed in U.S. Pat. Nos. 5,109,127 and 5,190,747 the entire contents of both of which are incorporated herein by reference. These sugar surfactants have the general formula II:

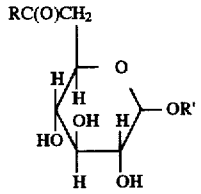

wherein R represents a fatty acid residue of 6 to 20 carbon atoms, preferably 6 to 12 carbon atoms and $R^1$ represents an alkyl group having 2 to 6 carbon atoms. Representative examples of such alkyl glucose esters are 1-ethyl-6-caprylglucoside, 1-ethyl-6-laurylglucoside, 1-butyl-6-caprylglucoside, 1-ethyl-6-palmitylglucoside and 1 -ethyl-6-oleylglucoside.

The aldobionamide sugar surfactants are generally disclosed in U.S. Pat. No. 5,310,542 and in published European Patent Application No. 550,281 both of which are incorporated herein by reference. An Aldobionamide is generally defined as the amide of an aldobionic acid or aldobionolactone and an aldobionic acid in turn is defined as a sugar substance (e.g. any cyclic sugar) in which the aldehyde group has been replaced by a carboxylic acid which upon drying is capable of cyclizing to form an aldonolactone. The aldobionamides can be based on compounds comprising two saccharide units, e.g. lactobionamides, maltobionamides, cellobionamides, melibionamides, or gentiobionamides, or they can be based on compounds comprising more than two saccharide units provided that the polysaccharide has a terminal sugar unit with an aldehyde group available.

The preferred aldobionamides of the present invention are lactobionamides of the formula III:

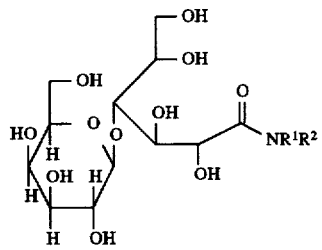

wherein $R^1$ and $R^2$ are the same or different and are selected from hydrogen and an aliphatic hydrocarbon radical containing up to about 36 carbon atoms (e.g. alkyl groups and alkenyl groups which groups may also include a heteroatom such as N, O, S, present, for instance, as an amide, carboxy, ether and/or saccharide moiety) except that $R^1$ and $R^2$ cannot simultaneously be hydrogen. The aliphatic hydrocarbon radical preferably contains up to 24 carbon atoms, most preferably from 8 to 18 carbon atoms. Representative examples of such lactobionamides are N-propyl lactobionamide, N-pentyl lactobionamide, N-decyl lactobionamide, N-hexadecyl lactobionamide, N-oleyl lactobionamide, N-dodecyl-N-methyl lactobionamide, and N-dodecyloxypropyl lactobionamide.

The gluconamide sugar surfactants are generally disclosed in U.S. Pat. No. 5,352,386 the entire contents of which is incorporated herein by reference. These surfactants have the general formula IV:

$$HOCH_2—(CHOH)_m—C(O)—NHR$$

wherein m is an integer from 2 to 5; and R is a straight or branched, saturated or unsaturated aliphatic hydrocarbon having 4 to about 24 carbon atoms, preferably 8 to 24 carbon atoms, which R group can also contain a heteroatom selected from the group consisting of oxygen, nitrogen and sulfur. Representative examples of such cosurfactants are N-octylerythronamide, N-decylerythronamide, N-dodecylerythronamide, N-tetradecylerythronamide, N-decylxylonamide and N-dodecylxylonamide.

The glyceramide sugar surfactants are generally disclosed in U.S. Pat. No. 5,352,387 the entire contents of which is incorporated herein by reference.

These cosurfactants have the general formula V:

$$HOCH_2CH(OH)C(O)NHR$$

wherein R is a $C_8$ to $C_{24}$ straight or branched chained, saturated or unsaturated aliphatic hydrocarbon in which the R group may also be substituted by a heteroatom selected from oxygen, nitrogen and sulfur. Representative examples of such cosurfactants are N-octylglyceramide, N-decylglyceramide and N-hexadecylglyceramide.

The glyceroglycolipid sugar surfactants are generally disclosed in U.S. Pat. No. 5,358,656, and published European Patent Application No. 550,279 the disclosure of each of which is incorporated herein by reference. The glyceroglycolipids can be of the formula VI:

$$A^1—O—CH_2—CH(B)—CH_2NRR_1$$

wherein $A^1$ is a saccharide, preferably having one or more saccharide units, more preferably a mono or disaccharide and most preferably a monosaccharide such as glucose or galactose; R and $R_1$ are the same or different and are hydrogen, a branched or unbranched hydrocarbon radical having from 1 to about 24, preferably from about 6 to about 18 carbon atoms; B is OH or a $NR^2R^3$ group, wherein $R^2$ and $R^3$ may be the same or different and are hydrogen, a branched or unbranched hydrocarbon radical having 1 to 24, preferably from 6 to 18 carbon atoms, and $NRR_1$ and B are positionally interchangeable. Representative examples of such cosurfactants are 3-(butylamino)-2-hydroxypropyl-β-D-galactopyranoside, 3-(octylamino)-2-hydroxypropyl-β-D-galactopyranoside, 3-(eicosylamino)-2-hydroxypropyl-β-D-galactopyranoside, 3-(butylamino)-2-hydroxypropyl-β-D-glucopyranoside, and 3-(pentylamino)-2-hydroxypropyl-β-D-mannopyranoside.

Other glyceroglycolipid surfactants are disclosed in published European Patent Application No. 550,280 which is incorporated herein by reference. These cosurfactants are of the formula VII:

$$A^1—O—CH_2—CH(OR_1)—CH_2OR$$

wherein $A^1$ is from 1 to 4 saccharide units and more preferably represents a mono or disaccharide, and most preferably a monosaccharide, for example, glucose or galactose; R and $R_1$ are the same or different and are hydrogen, or a branched or unbranched, saturated or unsaturated, hydrocarbon radical having from 1 to 24 carbon atoms, preferably from 6 to 18 carbon atoms. Representative examples of such cosurfactants are 3-(butyloxy)-2-hydroxypropyl-β-D-galactopyranoside, 3-(eicosyloxy)-2-hydroxypropyl-β-D-galactopyranoside, 3-(decyloxy)-2-hydroxypropyl-β-D-galactopyranoside, 3-(butyloxy)-2-hydroxypropyl-β-D-glucopyranoside, 3-(octyloxy)-2-hydroxypropyl-β-D-mannopyranoside, 3-(tetradecyloxy)-2-hydroxypropyl-β-D-lactoside, 3-(octadecyloxy)-2-hydroxypropyl-β-D-maltoside, 3-(octyloxy)-2-hydroxypropyl-β-D-galactotrioside, and 3-(dodecyloxy)-2-hydroxypropyl-β-D-cellotrioside.

The polyhydroxy fatty acid amide sugar surfactants are generally disclosed in U.S. Pat. Nos. 5,174,927, 5,223,179 and 5,332,528 the entire disclosure of each of which is incorporated herein by reference. The polyhydroxy fatty acid amide surfactant component of the present invention comprises compounds of the structural formula VIII:

$$R^2C(O)N(R^1)Z$$

wherein: $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In the above Formula $R^1$ can be, for example, N-methyl, N-ethyl, N-propyl, N-isopropyl, N-butyl, N-2-hydroxy ethyl, or N-2-hydroxy propyl.

$R^2C(O)N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Representative examples of such surfactants are N-methyl-N-1-deoxyglucityl cocoamide and N-methyl-N-1-deoxyglucityl tallowamide.

Other suitable polyhydroxy fatty acid amide surfactants (see U.S. Pat. Nos. 5,223,179 and 5,338,491, the entire contents of each which are incorporated herein by reference) are those of the formula IX:

$$RC(O)N(R^1)CH_2CH(OH)CH_2OH$$

wherein R is a $C_7$–$C_{21}$ hydrocarbyl species, i.e. coconut, tallow, palm fatty alkyl and oleyl, and $R^1$ is a $C_1$ to $C_6$ hydrocarbyl or substituted hydrocarbyl species, i.e. N-alkyl-N-(1,2-propanediol) and N-hydroxyalkyl-N-1,2-propane diol fatty acid amides. Representative examples of such cosurfactants are the tallow amide of 3-[2-(hydroxyethyl) amino]-1,2-propanediol (HEAPD), the palmitate amide of 3-methylamino-1,2-propanediol (MAPD) and the lauramide of MAPD.

The additive of the present invention is used to improve the tactile properties of the above-disclosed nonionic sugar surfactants.

The additive of the present invention is a copolymer of acrylamide and dimethyl diallyl ammonium chloride having a molecular weight ranging from about 400,000 to about 600,000, and preferably from about 500,000 to about 550,000. An example of a preferred additive is MERQUAT® 550, a copolymer of acrylamide and dimethyl diallyl ammonium chloride having a molecular weight of about 550,000, commercially available from Merck, Inc.

In one embodiment of the present invention there is provided a surfactant composition having enhanced tactile properties. The surfactant composition contains a combination of at least one of the above-disclosed nonionic sugar surfactants and the additive of formula II. The surfactant composition preferably contains from about 92 to about 99% by weight, and most preferably from about 95.0 to about 97.0% by weight of a nonionic sugar surfactant, and from about 1 to about 8% by weight, and most preferably from about 3.0% to about 5.0% by weight of the additive, all weights being based on the weight of the surfactant composition.

The nonionic sugar surfactant is preferably an alkyl polyglycoside of formula I wherein $R_1$ is a monovalent organic radical having from about 8 to about 16 carbon atoms, b is zero, and a is a number having a value of from about 1 to about 2.

According to another aspect of the invention, there is provided a process for enhancing the tactile properties of a nonionic sugar surfactant involving adding thereto an effective amount of the additive of formula II. The process involves combining the nonionic sugar surfactant and additive in the above-disclosed proportions, by conventional mixing means.

The present invention also provides a cleansing composition for treating keratinous substrates such as human hair having improved tactile properties. The cleansing composition of the present invention preferably contains from about 2 to about 15% by weight, and most preferably from about 6 to about 12% by weight of the above-disclosed surfactant composition, with the remainder water, all weights being based on the weight of the cleansing composition. Additional ingredients such as, for example: $C_{8-22}$ alkyl sulfates and their salts which may be ethoxylated with from 1–50 moles of (EO), cocoamides, their salts and derivatives thereof, along with citric acid, its salts and derivatives, may also be contained in the cleansing composition, without departing from the spirit of the invention.

The practice of this invention may be further appreciated by consideration of the following non-limiting, working examples, and the benefits of the invention may be further appreciated by reference to the comparison examples.

TACTILE IMPROVEMENT

Composition A A surfactant composition was prepared by combining 97% by weight of an alkylpolyglycoside, specifically, PLANTAREN® 2000 with 3% by weight of a copolymer of acrylamide and dimethyl diallyl ammonium chloride, specifically, MERQUAT® 550.

The following shampoo formulations were prepared in order to determine the tactile properties imparted by a surfactant composition of the present invention versus that of a control group.

EXAMPLE 1

| COMPONENT | % by weight |
|---|---|
| STANDAPOL ® ES-2 | 15.0 |
| STANDAMID ® SD | 3.0 |
| Composition A | 15.0 |
| thickener | 0.5 |
| Citric acid soln., pH to 6.5 | 2.0 |
| water | 64.5 |
| | 100.0 |

STANDAPOL® ES-2 is ammonium laureth sulfate having a degree of ethoxylation of about 2, available from Henkel Corp., Emery Division.

STANDAMID® SD is cocamide DEA, available from Henkel Corp., Emery Division.

COMPARISON EXAMPLE 1

COMPARISON EXAMPLE 1

| COMPONENT | % by weight |
|---|---|
| STANDAPOL ® ES-2 | 15.0 |
| STANDAMID ® SD | 3.0 |
| PLANTAREN ®-2000 | 15.0 |
| thickener | 0.5 |
| Citric acid soln., pH to 6.5 | 2.0 |
| water | 64.5 |
| | 100.0 |

Test Procedure:

Example 1 and Comparison Example 1 were used to wash human hair and then evaluated for the feel they imparted on the hair after washing. The results showed that those individuals using the hair shampoo containing the surfactant composition of the present invention found their hair to be soft and supple after washing. Conversely, those washing with Comparison Example 1 found that their hair felt very dry and tacky immediately following the washing. Thus, it can be seen that by incorporating the alkyl polyglycoside composition of the present invention into personal care products, the resultant tactile properties are significantly enhanced.

It should be noted, however, that in a process for cleansing human hair and/or skin, the amount of additive will vary, depending on the particular type of cleansing formulation being employed.

It will be recognized by those skilled in the art that changes may be made to the above-described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

What is claimed is:

1. A surfactant composition comprising:

(a) from about 92 to about 99% by weight, based on the weight of the composition, of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms: $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof; and (b) an additive consisting of a copolymer of acrylamide and dimethyl diallyl ammonium chloride.

2. The composition of claim 1 wherein the nonionic sugar surfactant is an alkyl polyglycoside of formula I.

3. The composition of claim 2 wherein in formula I $R_1$ is a monovalent organic radical having from about 8 to about 16 carbon atoms, b is zero, and a is a number having a value from about 1 to about 2.

4. The composition of claim 1 wherein the additive has a molecular weight ranging from about 400,000 to about 600,000.

5. The composition of claim 4 wherein the additive has a molecular weight ranging from about 500,000 to about 550,000.

6. The composition of claim 1 wherein the nonionic sugar surfactant is present in the composition in an amount of from about 95 to about 97% by weight, based on the weight of the composition.

7. The composition of claim 1 wherein the additive is present in the composition in an amount of from about 2 to about 5% by weight, based on the weight of the composition.

8. The composition of claim 1 wherein the nonionic sugar surfactant is a polyhydroxy fatty acid amide.

9. A process for enhancing the tactile properties of a nonionic sugar surfactant comprising:

(a) providing from about 92 to about 99% by weight, based on the weight of the composition, of a nonionic sugar surfactant selected from the group consisting of alkyl glucose esters, aldobionamides, gluconamides, glyceramides, glyceroglycolipids, polyhydroxy fatty acid amides, alkyl polyglycosides having general formula I:

$$R_1O(R_2O)_b(Z)_a$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1to about 6, and mixtures thereof;

(b) providing an ad d itive consisting of a copolymer of acrylamide and dimethyl diallyl ammonium chloride; and (c) mixing components (a) and (b) to form a surfactant blend.

10. The process of claim 9 wherein the nonionic sugar surfactant is an alkyl polyglycoside of formula I.

11. The process of claim 10 wherein in formula I $R_1$ is a monovalent organic radical having from about 8 to about 16 carbon atoms, b is zero, and a is a number having a value from about 1 to about 2.

12. The process of claim 9 wherein the additive has a molecular weight ranging from about 400,000 to about 600,000.

13. The process of claim 12 wherein the additive has a molecular weight ranging from about 500,000 to about 550,000.

14. The process of claim 9 wherein the nonionic sugar surfactant is present in the composition in an amount of from about 95 to about 97% by weight, based on the weight of the blend.

15. The process of claim 9 wherein the additive is present in the surfactant blend in an amount of from about 2 to about 5% by weight, based on the weight of the blend.

16. The process of claim 9 wherein the nonionic sugar surfactant is a polyhydroxy fatty acid amide.

17. A cleansing composition comprising:

(a) from about 2 to about 15% by weight, based on the weight of the composition, of a surfactant blend, the surfactant blend containing:

(i) from about 92 to about 99 weight, based on the weight of the surfactant blend of a nonionic sugar surfactant selected from the group consisting of alkyl glucose esters, aldobionamides, gluconamides, glyceramides, glyceroglycolipids, polyhydroxy fany acid amides, and mixtures thereof; and (ii) an additive consisting of a copolymer of acrylamide and dimethyl diallyl ammonium chloride; and (b) remainder water.

18. The composition of claim 17 wherein the nonionic sugar surfactant is a polyhydroxy fatty acid amide.

19. The composition of claim 17 wherein the additive has a molecular weight ranging from about 400,000 to about 600,000.

20. The composition of claim 19 wherein the additive has a molecular weight ranging from about 500,000 to about 550,000.

21. The composition of claim 17 wherein the additive is present in the blend in an amount of from about 1 to about 8% by weight, based on the weight of the blend.

22. The composition of claim 21 wherein the additive is present in the blend in an amount of from about 2 to about 5% by weight, based on the weight of the blend.

23. The composition of claim 17 wherein the nonionic sugar surfactant is present in the blend in an amount of from about 95 to about 97% by weight, based on the weight of the blend.

24. The composition of claim 17 further containing a component selected from the group consisting of $C_{8-22}$ alkyl sulfates and their salts, ethoxylated $C_{8-22}$ alkyl sulfates and their salts, cocoamides, their salts and derivatives thereof, citric acid, its salts and derivatives, and mixtures thereof.

* * * * *